US011837823B2

(12) United States Patent
Holveck

(10) Patent No.: US 11,837,823 B2
(45) Date of Patent: Dec. 5, 2023

(54) LOW-PROFILE SMART OUTLET

(71) Applicant: Lunar Energy, Inc., Mountain View, CA (US)

(72) Inventor: Mark Holveck, Sunnyvale, CA (US)

(73) Assignee: Lunar Energy, Inc., Mountain View, CA (US)

( * ) Notice: Subject to any disclaimer, the term of this patent is extended or adjusted under 35 U.S.C. 154(b) by 0 days.

(21) Appl. No.: 17/976,153

(22) Filed: Oct. 28, 2022

(65) Prior Publication Data

US 2023/0133835 A1 May 4, 2023

Related U.S. Application Data

(60) Provisional application No. 63/273,650, filed on Oct. 29, 2021.

(51) Int. Cl.
*H01R 13/707* (2006.01)
*H01R 24/76* (2011.01)
*H01R 13/703* (2006.01)

(52) U.S. Cl.
CPC ..... *H01R 13/707* (2013.01); *H01R 13/7038* (2013.01); *H01R 24/76* (2013.01)

(58) Field of Classification Search
CPC ... H01R 13/707; H01R 13/7038; H01R 24/76
See application file for complete search history.

(56) References Cited

U.S. PATENT DOCUMENTS 3,843,854 A * 10/1974 Mori ..... H01H 13/18 200/51.09
3,942,856 A * 3/1976 Mindheim ..... H01R 13/707 200/51.09
4,090,769 A * 5/1978 Damsky ..... H01R 31/00 439/652
4,419,554 A * 12/1983 Osika ..... H01H 1/58 200/284
4,530,556 A * 7/1985 Bonus ..... H01R 13/6395 439/304
4,579,410 A * 4/1986 Soloman ..... H01R 13/6397 439/651
4,705,342 A * 11/1987 Schwartz ..... H01R 25/003 D8/353
4,936,789 A * 6/1990 Ugalde ..... F21V 23/06 439/646
4,969,833 A * 11/1990 Lindow ..... H01R 13/70 200/43.11
5,551,884 A * 9/1996 Burkhart, Sr. ..... H01R 13/44 439/140

(Continued)

OTHER PUBLICATIONS

SimplySmartHome by switchmate. Switchmate Power. Feb. 8, 2019. https://web.archive.org/web/20190208011019/https://www.mysimplysmarthome.com/products/switchmate-power/.

*Primary Examiner* — Thanh Tam T Le

(74) *Attorney, Agent, or Firm* — Van Pelt, Yi & James LLP

(57) ABSTRACT

A switch includes an insulating barrier that blocks an electrical conductivity path between a plug prong and a contact of an electrical receptacle. It further includes a switched alternative conductivity path between the plug prong and the contact of the electrical receptacle. A portion of the switch is inserted into the electrical receptacle. The switch receives the plug prong, and the switch is substantially flush with a wall that includes the electrical receptacle.

6 Claims, 5 Drawing Sheets

(56) References Cited

U.S. PATENT DOCUMENTS

| | | | | |
|---|---|---|---|---|
| 6,171,129 | B1 * | 1/2001 | Phillips | H01R 31/06 439/263 |
| 6,603,385 | B2 * | 8/2003 | Kitchens | H01H 37/761 337/412 |
| 8,221,166 | B2 * | 7/2012 | Heffernan | H01R 13/70 439/651 |
| 9,402,498 | B2 * | 8/2016 | McRae | H01R 13/652 |
| 9,660,483 | B2 * | 5/2017 | Kim | H02J 9/005 |
| 10,038,283 | B2 * | 7/2018 | Oddsen | H01R 24/78 |
| 10,069,250 | B2 * | 9/2018 | Niwa | H01R 13/707 |
| 10,404,017 | B2 * | 9/2019 | AbuGhazaleh | H01R 13/7038 |
| 10,468,833 | B1 * | 11/2019 | Fusselman | H01R 24/30 |

* cited by examiner

LOW-PROFILE SMART OUTLET

CROSS REFERENCE TO OTHER APPLICATIONS

This application claims priority to U.S. Provisional Patent Application No. 63/273,650 entitled LOW-PROFILE SMART OUTLET filed Oct. 29, 2021 which is incorporated herein by reference for all purposes.

BACKGROUND OF THE INVENTION

Existing smart plugs and power outlet adapters are bulky and thick. This can limit where and how they can be placed.

BRIEF DESCRIPTION OF THE DRAWINGS

Various embodiments of the invention are disclosed in the following detailed description and the accompanying drawings.

DETAILED DESCRIPTION

Figure 1:
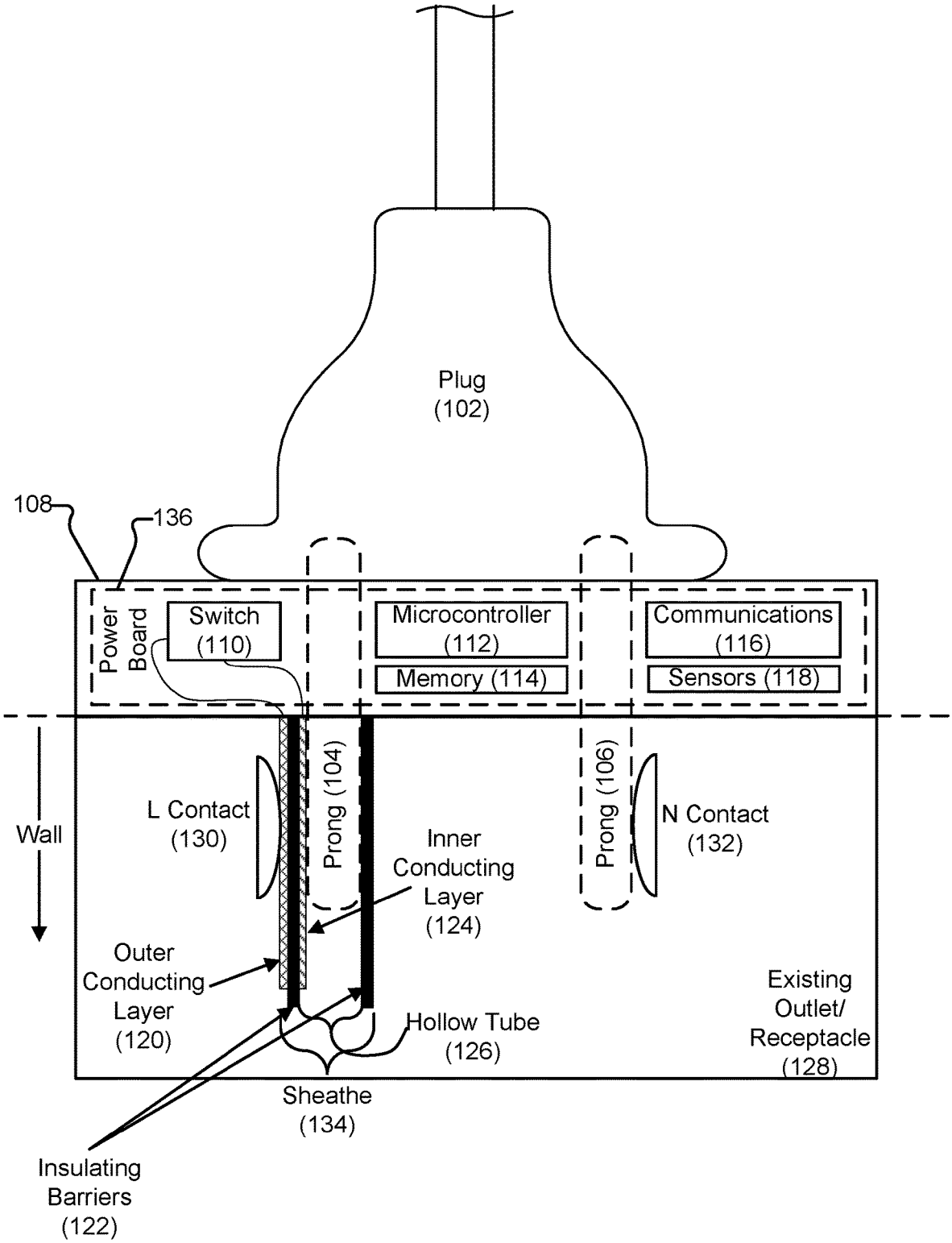
FIG. 1 illustrates an embodiment of a low-profile smart outlet.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Existing smart outlets are relatively thick because, in order for the prongs of a plug to fit into them, they are at least the depth of the plug so as to leave room for plug blade penetration depth. When inserting a device's plug into the smart plug that is in turn plugged into a wall outlet, the resulting stack of plugs may be difficult to fit in confined spaces, such as behind a couch that is in front of the wall outlet. Further, the stack of plugs may not be aesthetically pleasing. The following are embodiments of low-profile smart outlets.

Low Profile Smart Outlet with Passthrough

As will be described in further detail below, embodiments of the low-profile smart outlets described herein allow the prongs of a plug to enter into the existing holes of an electrical outlet or wall receptacle. In some embodiments, the low-profile smart outlet includes an insulating barrier between the prongs of the plug and wall outlet/receptacle, such that the metal prongs of the plug do not make contact with the contacts of the outlet. A switched alternative path between the plug prong/blade and the contact of the existing wall outlet is established that includes a controllable switch, which allows the smart switch to be in control of what voltage is applied to the prongs of the plug.

As one example, the smart switch includes insulated sheathes that encapsulate the prongs before the switch is plugged in. That is, the prongs are able to enter into the wall receptacle holes, but because of the insulated sheathe that encompasses the prongs, the prongs are unable to directly touch with the contacts of the wall outlet, and thus there is no direct electrical connection between the plug prongs and the wall outlet contacts.

In some embodiments, a body or package of the smart outlet includes a controllable switch that provides a controllable electrical connection between the prongs inside the insulating sheathe and the outlet contacts on the outside of the insulating sheathe.

In some embodiments, the sheathe includes three layers of material:

- An electrically insulating layer that acts as an electrical barrier between the prongs/blades inside the sheathe and the wall outlet contacts that are external to the sheathe. This blocks the typically direct connection between a plug prong and a contact of a slot in a wall outlet.
- An inner electrically conducting layer on the inside surface of the insulating barrier that makes contact with the prongs of the plug that are inside the sheathes.
- An outer electrically conducting layer on the outside surface of the insulating barrier that makes contact with the wall outlet contacts that are outside of the sheathe.

That is, there is a sandwich of layers with the insulating barrier in the middle, and conducting materials on either side of the insulating barrier (effectively sandwiching the insulating barrier).

As described above, the exterior of a sheathe includes an electrical conductor. The outer electrical conductor comes in contact with a contacts of a slot of an outlet, and conducts the voltage from the wall outlet to a printed circuit board (PCB) in the body of the smart outlet.

In some embodiments, the PCB includes a switch, which, when closed, connects the outer electrical conductor and the inner electrical conductor, thereby forming an electrical circuit. In this way, there is then an alternative electrical connection and path for electricity to flow between the wall outlet contact, to the outer electrical conductor, through the switch, to the inner electrical conductor, and to the prong of the plug. If the switch is opened, then the outer and inner electrical conductors are not connected, and thus the wall outlet contact and the plug prong are not connected, and no power can be delivered to the device attached to the plug (as the electrical circuit is broken).

In this example, even though the plug prongs are inside of the holes/slots of the wall outlet receptacle, they are separated from, and unable to directly touch or come in contact with, the contacts of the electrical outlet because of the insulating barrier surrounding the prongs. Further details regarding the passthrough low-profile smart outlet are described below.

FIG. 1 is a top-down view of a low-profile smart outlet. In this example, a plug 102 with prongs 104 and 106 is shown. In this example, the plug is plugged into low-profile smart outlet 108. As shown in this example, the prongs 104 and 106 of plug 102 pass through smart outlet 108, and protrude into the holes of an outlet in existing outlet box 128 (that is, for example, embedded in a wall). As shown in this example, the smart outlet 108 includes sheathe 134. In this example, the normal electrical path between plug prong 104 and high voltage outlet contact 130 is blocked by insulating barriers 122 of the sheathe that encircles or encompasses the prong 104.

As shown in this example, a switched alternative path is created via the smart outlet that is controllable so that whether the plug prong and the outlet contact are connected or not is controllable. As described above, the blocking of the normal path (plug blade directly touching outlet contact) is provided by insulating barriers 122 of the sheathe. Example of materials that the insulating layer is made of include thin and durable materials that are also highly voltage insulating (and block or prevent electricity from flowing through them), such as Kapton, Teflon, polyethylene plastics, etc.

In some embodiments, the sheathe has an inner conductive layer 124 for touching the prong 104 of the plug. The sheathe also has an outer conductive layer 120 for touching a contact (e.g., high voltage contact 130) of the existing wall outlet. As shown in this example, the insulating barrier layer of the sheathe is lined with an inner conductive layer within the sheathe, and also lined with an outer conductive layer on its outer surface. In some embodiments, the conductive layers are implemented using a conductive material such as a thin metal film or foil.

As shown in this example, the inner cavity (e.g., hollow tube 126) of the sheathe has a thin metal film that makes contact with plug prong 104 when the plug prong is inserted into the sheathe. In this example, the inner conductive layer 124 runs up along the inside of the sheathe all the way to power board 136 in the body of the smart outlet, where it makes contact with the power board. For example, the inner conductive layer makes contact with one end of a controllable switch 110 on the power board.

Similarly, as shown in this example, on the outside of the sheathe, there is a similar foil (e.g., outer conductive layer 120) that touches the contact 130 inside the outlet (when the smart outlet adapter is plugged in). The separate outer conductive layer also runs up the outside of the sheathe until it reaches the power board 136. For example, the inner conductive layer makes contact with an opposite end of controllable switch 110 on the power board. That is, one side of switch 110 is connected to the inner conducting layer (and the prong), and the other side of the switch is connected to the outer conducting layer (and the existing outlet contact).

As shown in this example, there is one piece of electrically conductive material on the exterior of the sheathe, and a piece of electrically conductive material on the interior of the sheathe. Both pieces of electrically conductive material come to the power board, where the connection between the outer and inner conductive layers is controlled by a controllable switch.

As shown in this example, the inner conductive layer and outer conductive layer are routed to different parts of the power board. For example, they are routed to different sides or terminals of switch 110. In some embodiments, the switch is a power switch on the PCB (printed circuit board) power board that makes (or breaks) the connection between the inner conductive layer and the outer conductive layer. That is, the inner/outer conductive layers and the switch (when closed) provide an alternative conductivity path for electricity between plug prong 104 and outlet contact 130.

One example of switch 110 is a relay, such as a mechanically actuated leaf spring. As another example, the switch is a solid-state set of switches such as MOSFETs (Metal-Oxide-Semiconductor Field-Effect Transistors). This allows the switch to be opened and closed, thereby respectively disconnecting and connecting the plug prong from the contact of the wall outlet. This provides off/on control. Closing of the switch connects the inner and outer conductive layers together, which in turn electrically connects a plug prong and the outlet contact together, allowing electricity to be delivered from the outlet to the plug. Opening of the switch disconnects the inner and outer conductive layers from each other, in which case electricity cannot be delivered to the plug, and the device that the plug is attached to cannot be powered on. If the device is currently on, then opening the switch turns off the device.

Power conversion circuitry may also be used to implement the switch (e.g., PWM (Pulse-Width Modulation) controlled solid state switch) to modulate or control the amount of power delivered to the plug (and the device that the plug is attached to).

In some embodiments, the switch is controllable. As one example, the smart outlet is configured to make a local, autonomous decision of how to control the switch. For example, the switch includes a microprocessor/microcontroller 112, memory 114, communications interface 116, and various electrical measurement sensors 118. In some embodiments, the smart outlet is programmed with automated load control algorithms that the microprocessor executes to determine how to control the switch. For example, based on electrical measurements taken via the sensors (which include voltage and/or current sensors, for example), the smart outlet determines whether the electrical system of the home is in a state in which it should turn off the power to the device that is plugged in (and open the switch). For example, if there is a power outage and the home is off-grid, or the power source for the home is stressed (which may be determined based on electrical measurements taken from the wall receptacle side), then, according to its programming, the smart outlet opens the switch, and disconnects the plugged in device from power (e.g., to relieve the load on the overall home energy system). As another example, the smart outlet is also controllable via explicit, on-demand commands from a remote controller. For example, the smart outlet includes communications interface 116. Examples of communications interfaces include interfaces for WiFi, 900 MHz communications, power line communications (PLC), etc. Via the communications interface, the smart outlet receives instructions or commands to turn on/off or otherwise control the power delivered to the plug or inserted device. The communications interface is also used to receive the aforementioned automated load control algorithms that are stored and executed at the smart outlet as well (e.g., from a remote entity). The communications interface may also be used to deliver status information from the smart outlet to a remote monitoring entity.

As shown in this example, the smart outlet is of a low-profile design (e.g., substantially flush with the wall) by allowing the prongs of the plug (of the device that is to be plugged in) to protrude into the outlet holes of the existing electrical receptacle/outlet. For example, the smart outlet described herein allows the prongs of the plug of a device to pass through a body of the smart outlet, and protrude (along with the sheathe) into the existing holes of a wall outlet/receptacle. Using the low-profile smart outlet described herein, room or space for the prongs need not be provided in the body of the smart outlet, as the existing space of the wall outlet is utilized to seat the prongs. The ability to allow the prongs to protrude into the existing holes of the outlet is facilitated by breaking the typical conductivity path/connection that would normally be made (e.g., directly between the prong and the outlet contact), by inserting an insulator between the plug prong and the outlet contact, and also providing an alternate controllable path between the plug prong and the outlet contact (e.g., via the separate outer/inner conducting layers that lead to different sides of a controllable switch).

In some embodiments, the aforementioned blocking of the normal conductivity path, and establishment of an alternative conductivity path (with controllable switch) is implemented for only one prong. For example, both prongs need not be blocked. From an electrical perspective, as long as connection of one of the prongs to an outlet contact is controlled, then the load can be controlled. In other embodiments, both prongs (e.g., high voltage and neutral) are both blocked using the sheathe as described herein. For a three-prong plug, the ground connection need not be blocked (and is left unblocked for safety). As one example, and as shown in the example of FIG. 1, the 120 V side prong is controlled, and the ground and neutral prongs are allowed to make normal, direct contact with the existing wall outlet contacts. For example, the neutral prong is allowed to pass through and connect directly with the wall contact, and the high voltage prong is sheathed. The neutral side may also be the prong that is controlled in other embodiments.

In other embodiments, the smart outlet includes sheathes (with the insulating barrier, outer conducting layer, and inner conducting layer) for both the high voltage and neutral prongs. Both sheathes may be connected to respective switches on the power board to connect or disconnect power to the plug.

As another example, the smart outlet includes two sheathe protrusions, one for each of the high voltage and neutral prongs. However, only one of the sheathes includes the insulating barrier (with outer and inner conductive layers that go to a switch in the power board), while the sheathe of the other prong is made of an electrically conductive material (no insulating barrier). As another example, there is also a sheathe for the ground prong that is made of an electrically conductive material (with no insulating barrier).

FIGS. 2A-2D illustrate embodiments of a low-profile smart outlet. As shown in these examples, a low-profile outlet smart switch is implemented by having the slots into which a device's plug is inserted into being aligned with, and physically protruding into, the slots of the original or existing outlet. Such a low-profile outlet smart switch eliminates the need for physical space outside of the wall to be reserved for a device's plug prongs to protrude into.

Figure 2C:
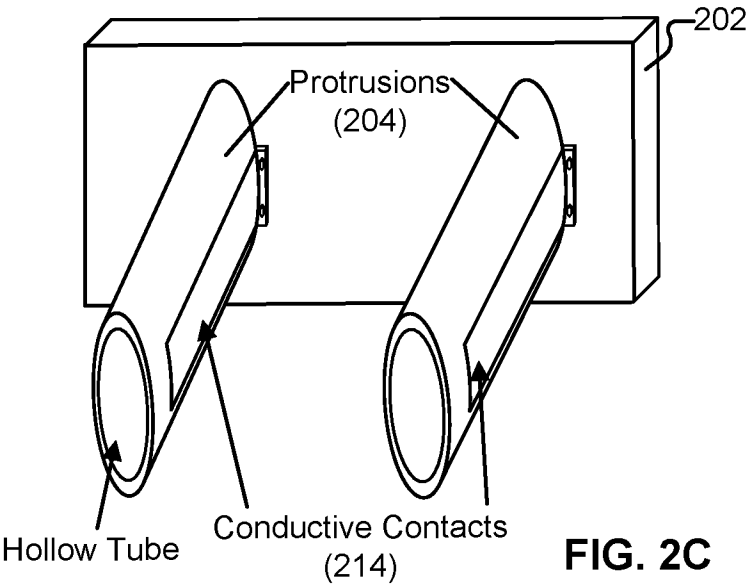
FIGS. 2A-2D illustrate embodiments of a low-profile smart outlet.
Figure 2A:
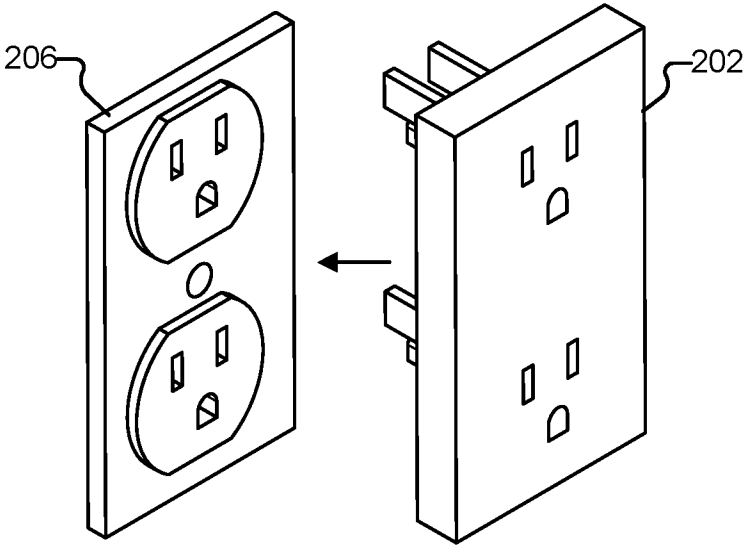

As shown in the example of FIG. 2C, the smart switch 202 has hollow, thin-walled, prong-shaped protrusions 204 (where one example of a protrusion is the sheathe described above) on the back. As shown in the example of FIG. 2A, the protrusions of the smart outlet 202 insert into the slots of existing receptacle/outlet 206 when the smart switch is "plugged in." As shown in FIG. 2A, in some embodiments, the smart outlet adapter 202 includes two new controllable outlets that insert into the two existing outlets that are typically found in wall outlet boxes.

Figure 2D:
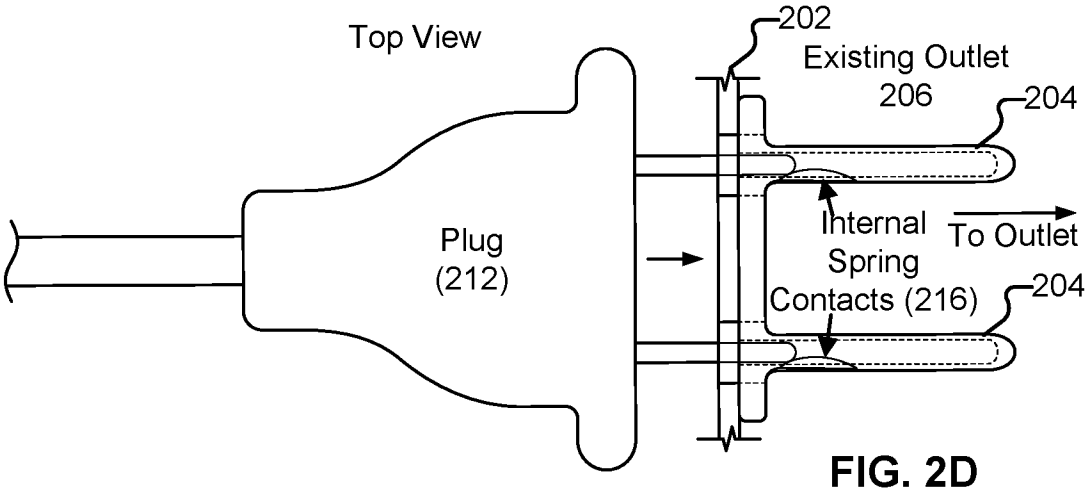
Figure 2B:
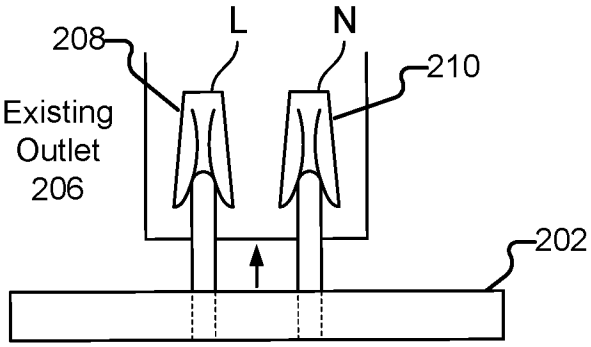

As described above, in some embodiments, at least one protrusion has a conductive material on its outer surface (e.g., conductive contacts 214) that contacts the spring-loaded contacts inside the original outlet, and this material is electrically connected to circuitry inside the smart switch package. An example of the protrusions of the smart outlet plugging into the spring-loaded contacts (e.g., high voltage contact "L" 208 and neutral contact 210) of existing outlet 206 is shown in the example of FIG. 2B. In some embodiments, the protrusions are otherwise non-conductive, for example, by using the insulating barrier described above, thereby preventing direct touching of a prong to the contact in the existing outlet. In some embodiments, a separate conductive contact (e.g., inner conductive layer described above) is inside at least one of the hollow protrusions (and is therefore insulated from the contacts on the outside of the protrusions), and the design of the combination of the protrusion (which includes an insulating barrier, as described above) and these inside contacts ensures physical contact between the inside contacts and any plug blade that might be inserted into the protrusion. In some embodiments, these contacts are also electrically connected to the circuitry inside the package of the smart switch. As described above, in some embodiments, a switch is included in the packaging/body of the smart outlet that controls whether the inner/outer conductive layers are electrically connected or disconnected from each other. Shown in the example of FIG. 2D is a top-down view of a device plug 212, inserted through the smart plug 202, where the prongs of the plug enter into the aforementioned protrusions 204 (e.g., as shown in the example FIG. 2C), where the conductive contacts 214 on the outer surface of the protrusions make contact with internal spring contacts 216 (which in some embodiments are examples of contacts 208 and 210) of the existing outlet 206 (that is, for example, installed in a wall).

In some embodiments, the remainder of the smart switch design may now be implemented without having to leave room for plug blade penetration depth and can thus be made very low-profile. Such freedom of design provides various benefits, such as improved aesthetics, facilitating installation in constrained spaces, etc.

Drywall Mounted Smart Outlet with Bridge

The following is another embodiment of a low-profile smart outlet. The following are embodiments of a drywall-mounted smart outlet. In this example, rather than having plug prongs pass through the board of the smart outlet and into the existing holes of the outlet, as in the low-profile smart outlet described above, the drywall-mounted smart outlet described herein is an adaptor plate that has room/depth for plug prongs and other componentry, where that space will be embedded in the area of a wall that is adjacent to an existing outlet, allowing the adaptor plate to be low-profile (e.g., the part that protrudes from the wall will be low-profile (e.g., substantially flush with the wall), while the remainder of the componentry is sunk into the wall). For example, existing wall outlets are typically connected to a stud. The drywall smart outlet described herein makes room for a device's plug prongs in the space adjacent to the existing receptable that is on the opposite side of the stud.

In some embodiments, the use of anchors allows for a self-wedging design that is able to be installed into drywall, creating space, within the drywall, for prongs and other electrical componentry. That is, the smart outlet packaging is thick enough to have sufficient depth for plug prongs/blades, but the bulk of that thickness is embedded into the drywall so that it does not protrude from the wall. Rather, it is sunken into the wall. In some embodiments, in order for the plug prongs of the newly added controllable outlets to access the power from the adjacent existing outlet, the smart outlet adaptor/plate includes a bridge portion, where the bridge portion is used to electrically bridge the existing outlet with the new controllable outlet(s). For example, on one end of the bridge portion is the drywall-embedded cavity for plug prongs inserted into the new, adjacent, controllable outlets. At the other end of the bridge portion are prongs that plug into the existing wall outlet/socket. In some embodiments, the smart outlet includes a thin power board (which in some embodiments is also flexible, and implemented using a flex PCB), that reaches from the drywall embedded end (that an end device plugs into), to the existing electrical receptacle.

In some embodiments, the bridge-side prongs are perpendicular to the power board. One side of the plate inserts into the existing receptacle. The new (controllable) outlet is embedded into the drywall next to the existing outlet. There is a power board in the bridge that brings power from the existing outlet to the newly embedded outlet. This effectively creates a new smart outlet that is next to the existing outlet. In this way, a low-profile smart outlet is provided that is embedded into the wall, and receives power from the existing receptacle. This provides various space-saving benefits. For example, typical smart plugs are the depth of the plug prongs that are inserted into them. When using existing smart plugs, the resulting layer or stack of plugs is relatively deep, as it involves the outlet, depth of the smart plug, and then depth of the plug. This can make it difficult to plug in devices into smart plugs that are to be fit in tighter spaces such as behind couches. Using the drywall-mounted smart outlet described herein, the additional depth of a smart plug protruding out of the wall is removed, as it is instead embedded into the wall.

Figure 3A:
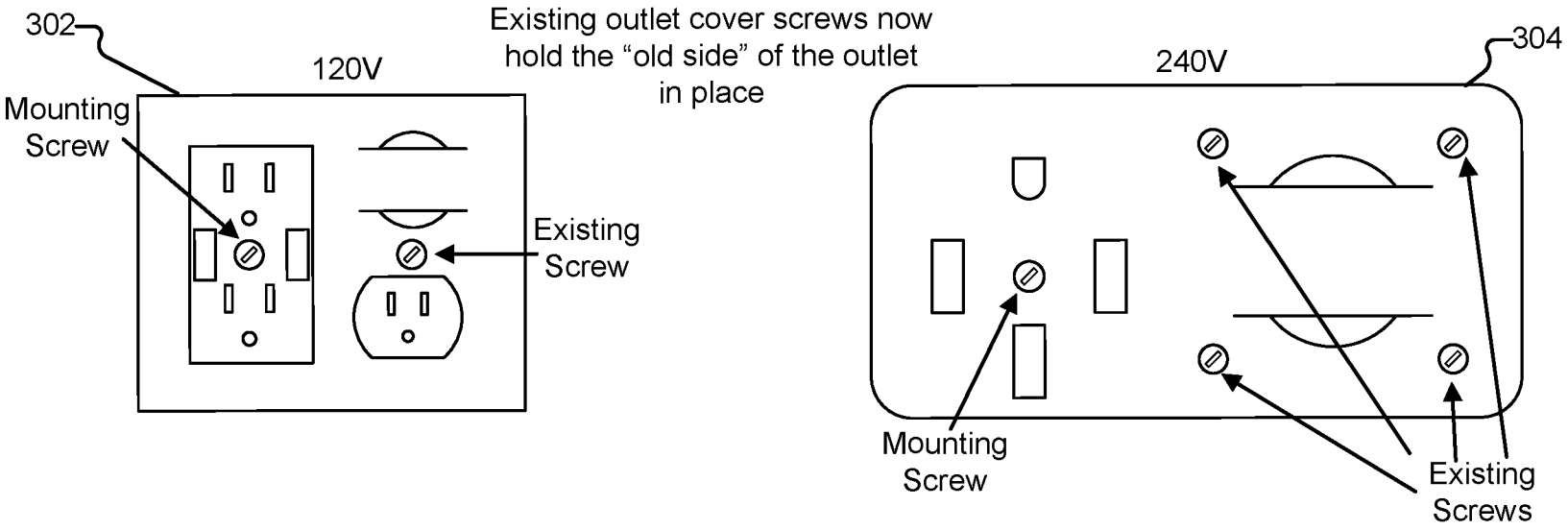
FIGS. 3A-3B illustrate embodiments of a wall-mounted low-profile smart outlet.
Figure 3B:
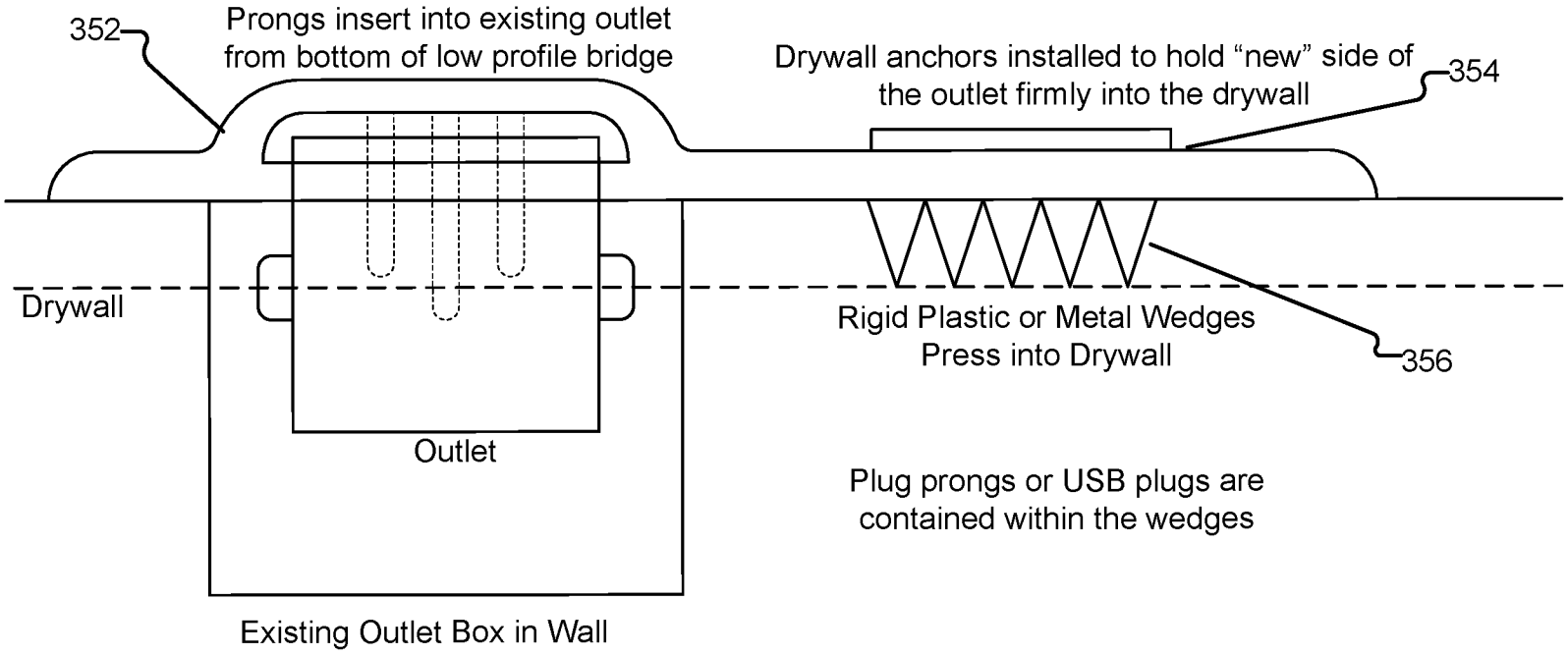

FIGS. 3A-3B illustrate embodiments of a (dry)wall-embedded smart outlet. As shown in this example, a double outlet is effectively created in the space where there had previously only been one existing outlet.

As described above, in various embodiments, the drywall press-in outlet makes room for plug prongs in the drywall adjacent to the original outlet, whether it is, for example, a 240 V outlet or 120 V outlet. Two example versions are shown in the example of FIG. 3A. For example, a 120V version of the smart outlet is shown at 302. A 240V version of the smart outlet is shown at 304. As shown in the examples of FIG. 3A, the existing outlet cover screws now hold the "old side" of the outlet (the existing outlets) in place.

FIG. 3B illustrates a top-down view of a smart outlet with a low-profile bridge. In some embodiments, as shown in the example of FIG. 3B, a portion 352 of the smart outlet replaces the outlet cover of the existing outlet while also plugging into the existing outlet with a low-profile bridge. In some embodiments, the other portion 354 has switched outlets in it with room for plug prongs to penetrate into the smart switch. In some embodiments, this room is contained within hard plastic or metal wedges 356 (or any other type of wall mounting mechanism, as appropriate) that can be pressed, with use of a hammer if needed, into the drywall (e.g., adjacent to the existing outlet) in order that the smart switch can lay flat or substantially flush against the wall. In some embodiments, the appearance of the smart switch is similar to a standard outlet cover for aesthetics, as shown in the examples of FIG. 3A. One or more drywall anchors may be used on the "new" side 354 of the smart switch to facilitate pressing the wedges into the drywall and hold it firmly against the drywall permanently.

As shown in the example of FIG. 3A, in some embodiments, existing outlet cover screws are used to hold the "old" side of the outlet in place. In the example of FIG. 3B, prongs of the smart outlet insert into the existing outlet from the bottom of the low-profile bridge 352. In some embodiments, drywall anchors are installed to hold the "new" side 354 of the outlet (with the controllable outlets) firmly into the drywall. In some embodiments, plug prongs and/or USB (Universal Serial Bus) plugs are contained within the wedges.

Figure 4:
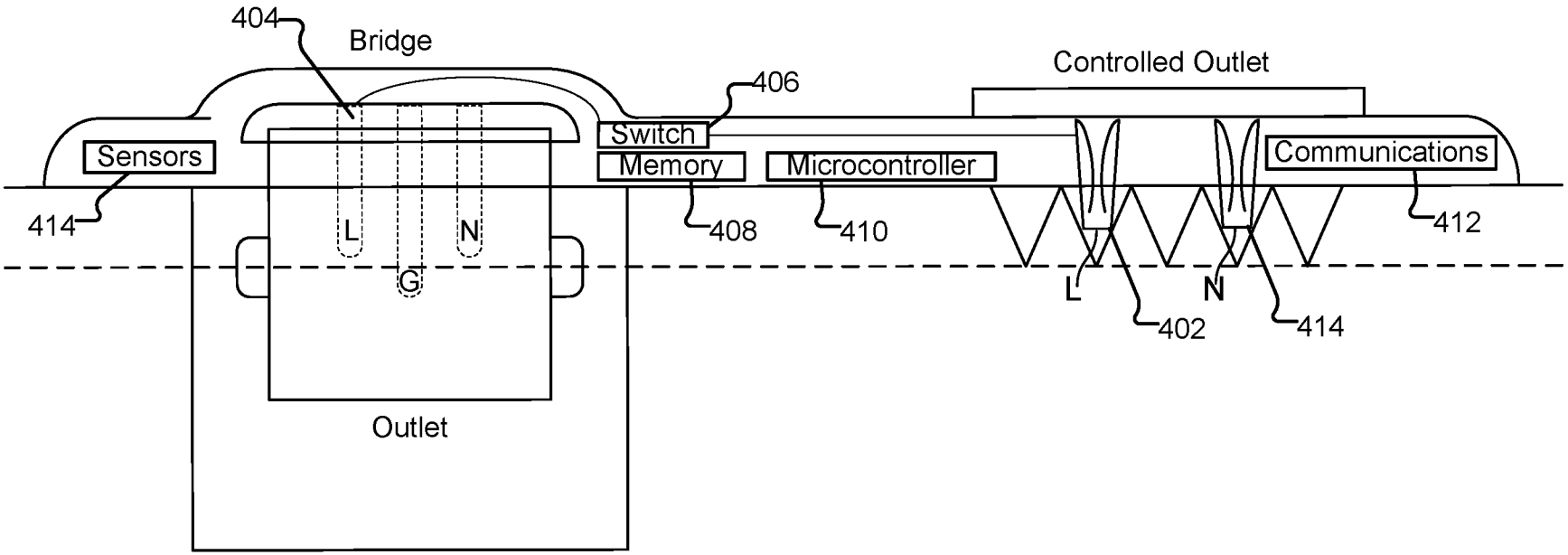
FIG. 4 illustrates an embodiment of a wall-mounted low-profile smart outlet.

FIG. 4 illustrates an embodiment of a wall embedded smart outlet that includes a bridge to an existing outlet. In some embodiments, the smart outlet includes a power board (e.g., flexible PCB (printed circuit board) power board), where the power board includes wiring, circuitry, and traces that connect (or disconnect) the prongs on the "new" side (with the controlled outlet) to the prongs inserted into the existing outlet. For example, with respect to electrical connectivity, in some embodiments, each contact of the new outlet is connected to a corresponding contact of the existing outlet, where one or more of the connections include, inline, a controllable switch or relay as described above. This allows the electrical circuit/connection between the new outlets and the existing outlets to be switched open or closed.

In some embodiments, each of the new outlets are switched outlets that are controllable via one or more switches that are placed in line with the connection from the switched outlets to the bridge-side prongs inserted into the existing outlet. Examples of such switches include relays and solid-state switches such as those described above. As one example, the new side of the smart outlet includes an outlet with slots that the prongs/plug blades of a device's plug are inserted into. As one example, the outlet includes slots for high voltage, neutral, and ground. The slots include contacts (e.g., spring-loaded contacts) that touch the prongs of the plug that is inserted into the new outlet slots. For example, a spring-loaded contact for delivery of high voltage is shown at 402. A spring-loaded contact for neutral is shown at 414.

In some embodiments, as shown in the example of FIG. 4, a connectivity path is established or otherwise provided within the smart outlet from the contact of the high voltage slot of the new controlled outlet (e.g., high voltage contact 402), to the corresponding high voltage prong 404 of the bridge that is inserted into the existing outlet. Connectivity paths from the controlled outlet slots to the existing outlet slots (not shown) are also established. In some embodiments, a controllable switch 406 is placed inline of the connectivity path from the contact 402 of the high voltage slot of the new outlet to the high voltage prong of the bridge. If the switch is opened, then the new switched outlet's high voltage contact is disconnected from the high voltage prong of the bridge (that is inserted into existing outlet), and no power is delivered to the device that is plugged into the new outlet. If the switch is closed, then power is deliverable, as there is a connection path between the new outlet's high voltage contact and the corresponding high voltage prong of the low-profile bridge that is inserted into the existing outlet. As described above, examples of the switch include relays, solid state switches, etc.

In some embodiments, similar to the low-profile smart outlet of FIG. 1, the power board in the bridge of the drywall-mounted smart outlet also includes a memory 408, a microcontroller 410, communications interface 412, and sensors 414. Similar to the low-profile smart outlet of FIG. 1, in some embodiments, the smart outlet of FIG. 4 is configured to autonomously determine whether to turn on/off or otherwise modulate or control power to the plugged in device(s) (e.g., based on electrical measurements using the sensors and/or executing automated load control programs). The smart outlet is also configured to execute on-demand instructions or commands to switch on/off power to plugged in device(s). As described above, in some embodiments, the automated load control programs and/or commands are received from an external entity via the communications interface. The smart outlet may also use the communications interface to report back to the remote entity. That is, the communications interface allows the smart outlet to communicate with entities external to the smart outlet.

In some embodiments, components of the smart outlet are distributed or located at various locations within the smart outlet. For example, the wall anchoring portions of the smart outlet (e.g., portions of the outlet that enter the wall and anchor it to the wall) include cavities that are spaces in which to include electrical components. Components may be on the power board, or with the prongs that are inserted into the existing outlet, or where the new outlet is located (and embedded in the wall). In various embodiments, componentry may be included on the power board (which in some embodiments is included in the bridge linking the new, switched outlet with the existing outlet) or located in the cavities of the wedges that are embedded in the wall. For example, a communications interface such as that described above is included in the embedded portion of the smart outlet. A microcontroller such as that described above may also be included in the drywall-embedded portion of the smart outlet.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A switch, comprising:

an insulating barrier that blocks an electrical conductivity path between a plug prong and a contact of an electrical receptacle;

a switched alternative conductivity path between the plug prong and the contact of the electrical receptacle; and a sheathe that receives the plug prong, wherein the sheathe comprises the insulating barrier, an inner conductive layer, and an outer conductive layer, and wherein the inner conductive layer and the outer conductive layer are separated by the insulating barrier;

wherein a portion of the switch is inserted into the electrical receptacle; and wherein the switch is substantially flush with a wall that includes the electrical receptacle.

2. The switch of claim 1, wherein the inner conductive layer is in contact with the plug prong, and the outer conductive layer is in contact with the contact of the electrical receptacle.

3. The switch of claim 2, wherein the switched alternative conductivity path comprises the inner conductive layer, the outer conductive layer, and a controllable switch.

4. The switch of claim 3, wherein the controllable switch is used to control voltage applied to the plug prong.

5. The switch of claim 1, wherein the insulating barrier blocks the electrical conductivity path between the plug prong and a high voltage contact of the electrical receptacle.

6. The switch of claim 1, wherein the plug prong passes through at least some of the switch, and protrudes into the electrical receptacle.

* * * * *